US008220075B2

(12) United States Patent
Chen et al.

(10) Patent No.: US 8,220,075 B2
(45) Date of Patent: Jul. 17, 2012

(54) MULTI-TOOL COLLAR STAY

(75) Inventors: Donny Chen, Baltimore, MD (US); Frederick Li, Monroeville, PA (US); Franklin Shen, Lancaster, PA (US)

(73) Assignee: VIICII LLC, Baltimore, MD (US)

( * ) Notice: Subject to any disclaimer, the term of this patent is extended or adjusted under 35 U.S.C. 154(b) by 220 days.

(21) Appl. No.: 12/721,560

(22) Filed: Mar. 10, 2010

(65) Prior Publication Data

US 2011/0219515 A1 Sep. 15, 2011

(51) Int. Cl.
*A41B 3/00* (2006.01)

(52) U.S. Cl. ..... 2/132; 2/255; 2/256; D8/18

(58) Field of Classification Search ..... 2/132, 255–264, 2/260.1, 134; D8/16, 18, 19, 20; 7/170
See application file for complete search history.

(56) References Cited

U.S. PATENT DOCUMENTS

| | | | | | |
|---|---|---|---|---|---|
| 1,464,658 | A | * | 8/1923 | Johnson | 223/83 |
| 1,972,920 | A | * | 9/1934 | Deuse | 7/156 |
| 2,004,288 | A | * | 6/1935 | Krick | 2/132 |
| 2,697,834 | A | * | 12/1954 | Robinson | 2/132 |
| 2,799,024 | A | * | 7/1957 | Oscard | 2/132 |
| 2,884,640 | A | * | 5/1959 | Liebowitz | 2/132 |
| 3,039,112 | A | * | 6/1962 | Sucher | 2/132 |
| 3,075,202 | A | * | 1/1963 | Rubio | 2/132 |
| 3,394,410 | A | * | 7/1968 | Liebowitz | 2/260.1 |
| 3,686,692 | A | * | 8/1972 | Snare et al. | 2/132 |
| 3,832,737 | A | * | 9/1974 | Podolsky | 2/132 |
| 4,364,125 | A | * | 12/1982 | de Riz et al. | 2/255 |
| D270,807 | S | * | 10/1983 | Dilliner | D8/18 |
| 5,169,305 | A | * | 12/1992 | Kee | 431/253 |
| D354,895 | S | * | 1/1995 | Flynn | D8/16 |
| D356,240 | S | * | 3/1995 | Meldahl | D8/105 |
| 6,289,542 | B1 | * | 9/2001 | Dignam | 7/151 |
| D528,880 | S | * | 9/2006 | Belflower | D8/16 |
| 7,409,730 | B2 | * | 8/2008 | Boos | 2/132 |
| 2006/0218695 | A1 | * | 10/2006 | Boos | 2/129 |
| 2008/0134410 | A1 | * | 6/2008 | Eisenberg | 2/132 |
| 2008/0295218 | A1 | * | 12/2008 | Boos | 2/132 |
| 2009/0144879 | A1 | * | 6/2009 | Newberry | 2/132 |
| 2010/0088801 | A1 | * | 4/2010 | Spiros | 2/132 |

* cited by examiner

*Primary Examiner* — Khoa Huynh
*Assistant Examiner* — Andrew W Collins

(57) ABSTRACT

A multi-tool collar stay is disclosed. The collar stay may be a non-bendable single piece that includes a first end, a middle section, and a second end. This single piece is shaped to substantially fit within a collar stay pocket, where the first end is tapered to be proximate to a collar tip, and a first tool may be located in the vicinity of the first end. The second end is proximate to a collar stay pocket entrance, and a second tool may be located in the vicinity of the second end. The non-bendable single piece collar stay comprises at least one of: titanium, brass, stainless steel, sterling silver, reinforced polymer, and/or a combination thereof. Examples of the first and second tool include: a bottle opener, a cutting blade, a flat head screw driver, a flat Phillips screw driver, a full Phillips screw driver, a nail file, and a ruler.

20 Claims, 5 Drawing Sheets

MULTI-TOOL COLLAR STAY

BACKGROUND OF THE INVENTION

The present invention relates to clothing accessories, and in particular to collar stays for stabilizing the collar points of a dress shirt.

A variety of collar stays are used to keep a collar looking well-pressed and in place. Collar stays are shirt accessories typically made of a thin plastic or a metal material such as brass, stainless steel, or sterling silver. These thin accessories fit within a collar stay pocket provided on the underside of the collar. A pointed end of the stay is inserted first into the pocket. The other end of the stay is rounded and is kept short enough so that it does not interfere with the crease of the collar. A key benefit to having metal collar stays is the rigidity and the weight of the metal material keeps the collar very firm.

As described above, the main purpose for a collar stay is to keep a collar rigid to present a well-groomed appearance. However, because collar stays can be taken out (e.g., at a party to show others, or prior to laundering to prevent damage), additional uses could exist for collar stays. A need therefore exists for a collar stay with improved features.

An object of the present invention is to provide a collar stay that is also configured to be a multiple purpose tool.

BRIEF SUMMARY OF THE INVENTION

The present invention provides an apparatus that fits into a collar stay pocket for keeping a shirt collar stiff, and acts as a multiple purpose tool. The apparatus comprises a non-bendable single piece including a first end, a middle section, and a second end. The single piece is shaped to substantially fit within the collar stay pocket, where the first end is tapered to be proximate to a collar tip, and a first tool may be located in the vicinity of the first end. The second end is proximate to a collar stay pocket entrance, and a second tool may be located in the vicinity of the second end. The non-bendable single piece collar stay comprises at least one of: titanium, brass, stainless steel, sterling silver, reinforced polymer, and/or a combination thereof. Examples of the first and second tool include: a bottle opener, a cutting blade, a flat head screw driver, a flat Phillips screw driver, a full Phillips screw driver, a nail file, and a ruler. In some embodiments, the middle section further comprises a tool, such as a bottle opener, a cutting blade, a flat head screw driver, a flat Phillips screw driver, a full Phillips screw driver, a nail file, and a ruler. The middle section and the second end of the non-bendable collar stay may have a maximum width in the range of ⅛th of an inch to ½ of an inch. The maximum thickness of the non-bendable single piece collar stay may be in the range of 1/32 of an inch to ¼ of an inch. In some embodiments, the present invention allows for two multi-tool collar stays to combine. A second non-bendable collar stay is configured to attach with the first non-bendable collar stay to form a third tool, where the second collar stay is shaped to substantially fit within another collar stay pocket. The second collar stay may couple with the first collar stay at a pivot point located at the second end of the first collar stay. Examples of the third tool include: scissors, a can opener, and a ruler.

An embodiment of the present invention provides a multi-tool collar stay apparatus that comprises a non-bendable first piece including a first front section, a first middle section, and a first back section. The multi-tool collar stay apparatus also comprises a non-bendable second piece coupled with the first piece such that the second piece fits on top of and in-line with the first piece, where a bottom surface of the second piece is in direct contact with a top surface of the first piece. In this embodiment, both the first piece and second piece are shaped to substantially fit within the same collar stay pocket, where the first front section is tapered to be proximate to a collar tip, and the first back section is proximate to a collar stay pocket entrance. The first piece and second piece may form at least one of a first tool. Examples of the first tool include: scissors, a ruler, and a can opener. The non-bendable first and second pieces comprise at least one of: titanium, brass, stainless steel, sterling silver, reinforced polymer, and/or a combination thereof. In some embodiments, the first piece also includes at least one of a second tool, the second tool comprising: a bottle opener, a cutting blade, a flat head screw driver, a flat Phillips screw driver, a full Phillips screw driver, a nail file, and a ruler. The second piece may also include at least one of a third tool, the third tool comprising: a bottle opener, a cutting blade, a flat head screw driver, a flat Phillips screw driver, a full Phillips screw driver, a nail file, and a ruler. The multi-collar stay apparatus may further include a pivot piece that couples the second piece with the first piece at a pivot point located at the first back section of the first collar stay piece. In some embodiments, the first middle section further comprises at least one of: a bottle opener, a cutting blade, a flat head screw driver, a flat Phillips screw driver, a full Phillips screw driver, a nail file, and a ruler. The first and second pieces may have a maximum width in the range of ⅛th of an inch to ½ of an inch. The maximum thickness of the first and second pieces when the second piece is directly on top of the first piece may be in the range of 1/32 of an inch to ¼ of an inch. In some embodiments, the second piece of multi-tool collar stay apparatus includes a second front section, a second middle section, and a second back section, where the second front section comprises at least one of: a bottle opener, a cutting blade, a flat head screw driver, a flat Phillips screw driver, a full Phillips screw driver, a nail file, and a ruler. The second middle section may comprise at least one of: a bottle opener, a cutting blade, a flat head screw driver, a flat Phillips screw driver, a full Phillips screw driver, a nail file, and a ruler. The second back section may further comprise at least one of: a bottle opener, a cutting blade, a flat head screw driver, a flat Phillips screw driver, a full Phillips screw driver, a nail file, and a ruler. In this embodiment, the second piece is substantially the same size as the first piece.

There are a number of advantages of the present invention. The use of a collar stay as a multiple purpose tool takes particular advantage of its portability and small size. While the present invention is a fashion accessory that has a functional purpose of keeping a collar stiff, the present invention also has additional functions, such as acting as one or more tools used to perform or facilitate manual or mechanical work.

DETAILED DESCRIPTION OF THE INVENTION

Figure 1:
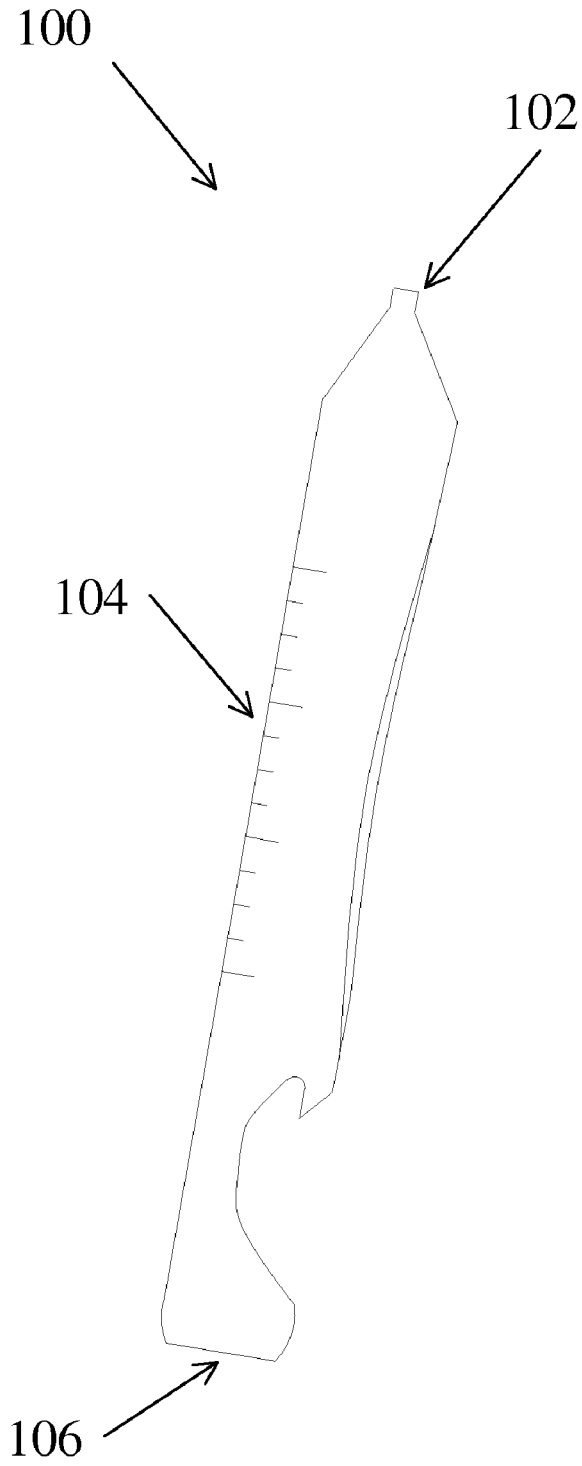
FIG. 1 illustrates an example of a multi-tool collar stay.

FIG. 1 illustrates an embodiment of the present invention. Collar stay 100 includes a first end 102, a middle section 104, and a second end 106. In one embodiment of the present invention, collar stay 100 is a non-bendable single piece that is made of titanium, brass, stainless steel, sterling silver, reinforced polymer, and/or a combination of these materials. Examples of reinforced polymer are para-aramid synthetic fibers and other Kevlar-like composites. In this disclosure, the term "non-bendable" is defined as not capable of being bent or flexed by standard human force. While many prior art collar stays are made of plastic or other materials that can be flexed by the human hand, the multi-tool collar stay of the present invention is made of a material such as titanium that is not bendable by a normal/standard human force. Benefits for having a non-bendable multi-tool collar stay are described below.

Figure 2:
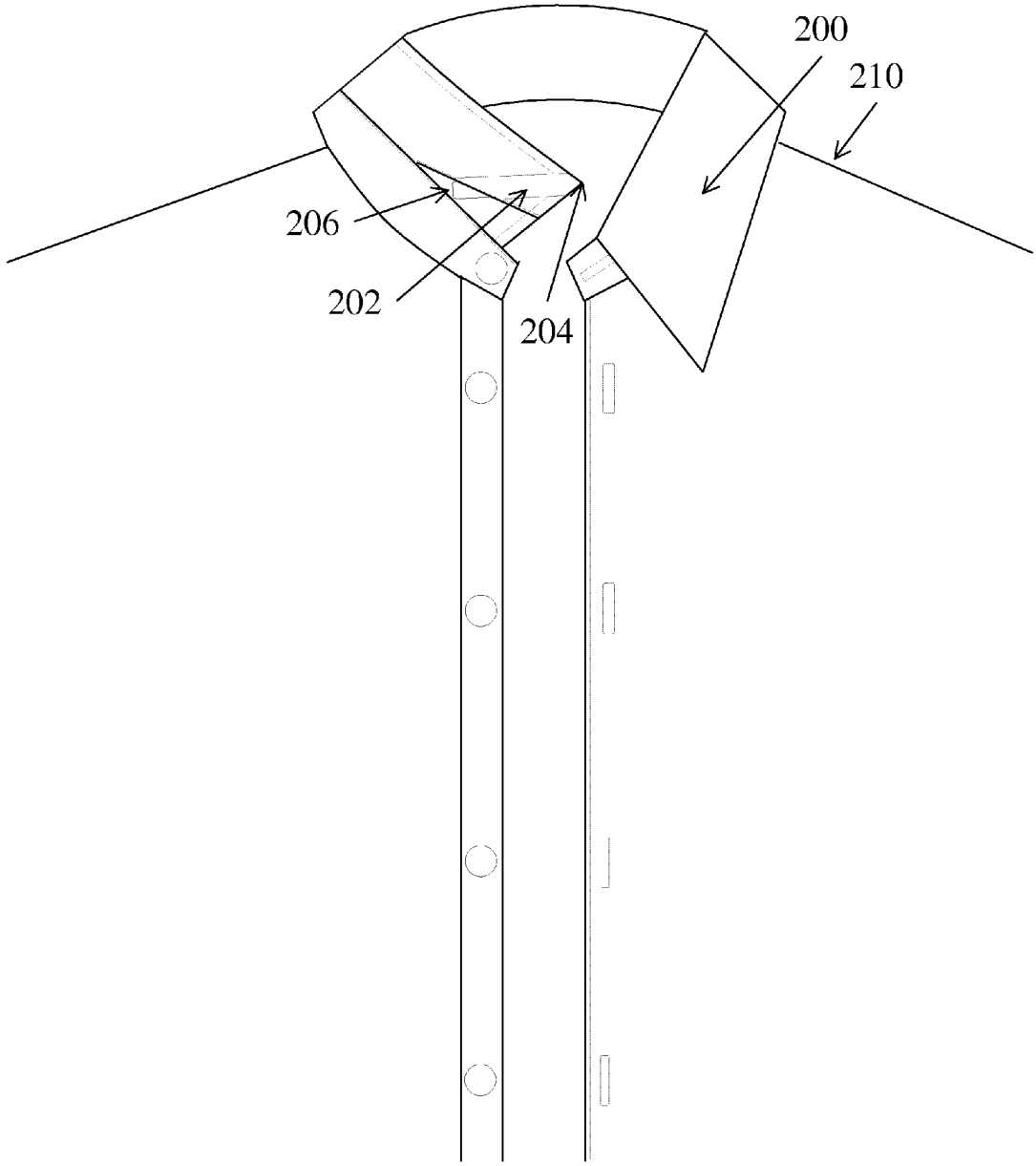
FIG. 2 illustrates an example of the multi-tool collar stay fitting inside a collar stay pocket of a dress shirt.

First end 102 has a tapered shape to fit nearest collar tip 204 when inserted into collar stay pocket 202 (see FIG. 2). In one embodiment, first end 102 is fabricated to include a flat head screwdriver that is located in the vicinity of first end 102. Shaping techniques for patterning titanium, brass, stainless steel, sterling silver, and reinforced polymer are well known, and thus will not be described in further detail. In this disclosure, the term "vicinity" is defined as the area or region near or about a place. In other embodiments of the present invention, first end 102 includes a flat Phillips screwdriver or a full Phillips screwdriver. Many advantages exist for having a tool such as a screwdriver located in the vicinity of first end 102. In this disclosure, the term "tool" is defined as a device used to perform or facilitate manual or mechanical work.

While prior art collar stays acted as fashion accessories to keep collars stiff, the collar stay of the present invention also has additional functions, such as performing or facilitating manual or mechanical work. For example, imagine a scenario where a user is wearing collar stay 100 within collar stay pocket 202 of dress shirt 210 in a professional office environment, and does not have immediate access to a traditional tool kit. Next, the user accidentally drops his eyeglasses, loosening an arm of the eyeglass frame. The user desires to tighten the screw connecting the arm to the front of the eyeglass frame. Even though the user cannot find a tool kit in the office, because the user is wearing the collar stay of the present invention, the user is able to take out collar stay 100 from his dress shirt 210 and use this multi-tool collar stay to tighten the screws on his eyeglasses. Another potential use for the small screwdriver of collar stay 100 could be for opening up a cell phone cover. The non-bendable aspect of collar stay 100 facilitates such mechanical work. It should be recognized that many other uses for the small screwdriver of collar stay 100 exist. Thus, many benefits are achieved by having a multi-tool collar stay with a small screwdriver that is portable and wearable inside collar stay pocket 202 located on the underside of collar 200.

Referring back to FIG. 1, middle section 104 may include one or more tools. Examples of tools include: a bottle opener, a cutting blade, a flat head screw driver, a flat Phillips screw driver, a full Phillips screw driver, a nail file, and a ruler. In the embodiment shown, a left side of middle section 104 (from this top view of FIG. 1) includes a ruler. The ruler of collar stay 100 may measure either English or Metric units. A right side of middle section 104 (from this top view of FIG. 1) includes a knife (e.g., a stainless steel cutting blade) that can be used for cutting thread or other materials. In another embodiment of the present invention, middle section 104 includes a nail file (not shown in FIG. 1). When collar stay 100 is inserted into collar stay pocket 202, second end 106 fits nearest collar stay pocket opening 206 (opening 206 can also be referred to as a collar stay pocket entrance). In the embodiment shown, second end 106 is fabricated such that a bottle opener is located in the vicinity of second end 106. Advantages exist for having a tool such as a ruler located at middle section 104 and a bottle opener located in the vicinity of second end 106. For example, imagine a scenario where the user is in a social setting such as a party, and does not have access to a traditional ruler or a traditional bottle opener. The user desires to make a small measurement. Even though the user cannot find a traditional ruler at the party, because the user is wearing the collar stay of the present invention, the user is able to take out collar stay 100 from his dress shirt and make a small measurement. When the user's friend is having trouble opening a drink bottle, the user takes out collar stay 100 from his dress shirt, opens the drink bottle, and impresses the crowd.

Figure 3:
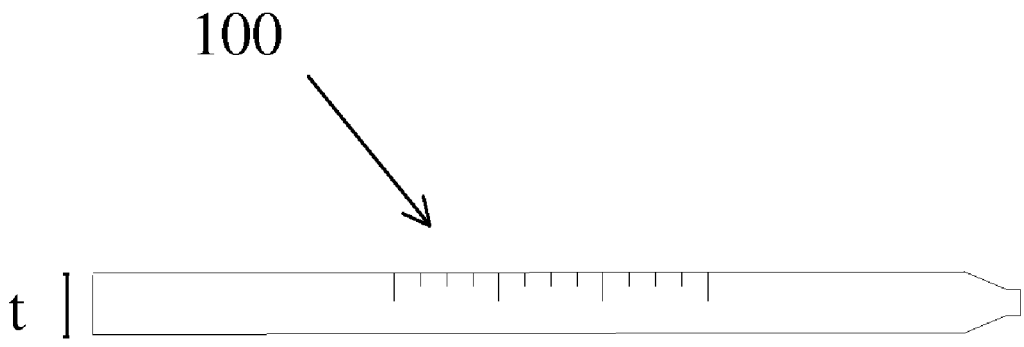
FIG. 3 illustrates a side view of an example of the multi-tool collar stay.

In order to fit within collar stay pocket 202, the maximum width of middle section 104 may be in the range of $\frac{1}{8}^{th}$ of an inch to ½ of an inch. In one embodiment of the present invention, the maximum width of middle section 104 is ¼ of an inch. The maximum width of middle section 104 may be substantially the same as the maximum width of second end 106. FIG. 3 is a side view illustrating the multi-tool collar stay of the present invention. In order to fit within collar stay pocket 202, the maximum thickness t of collar stay 100 is in the range of 1/32 of an inch to ¼ of an inch.

Figure 4:
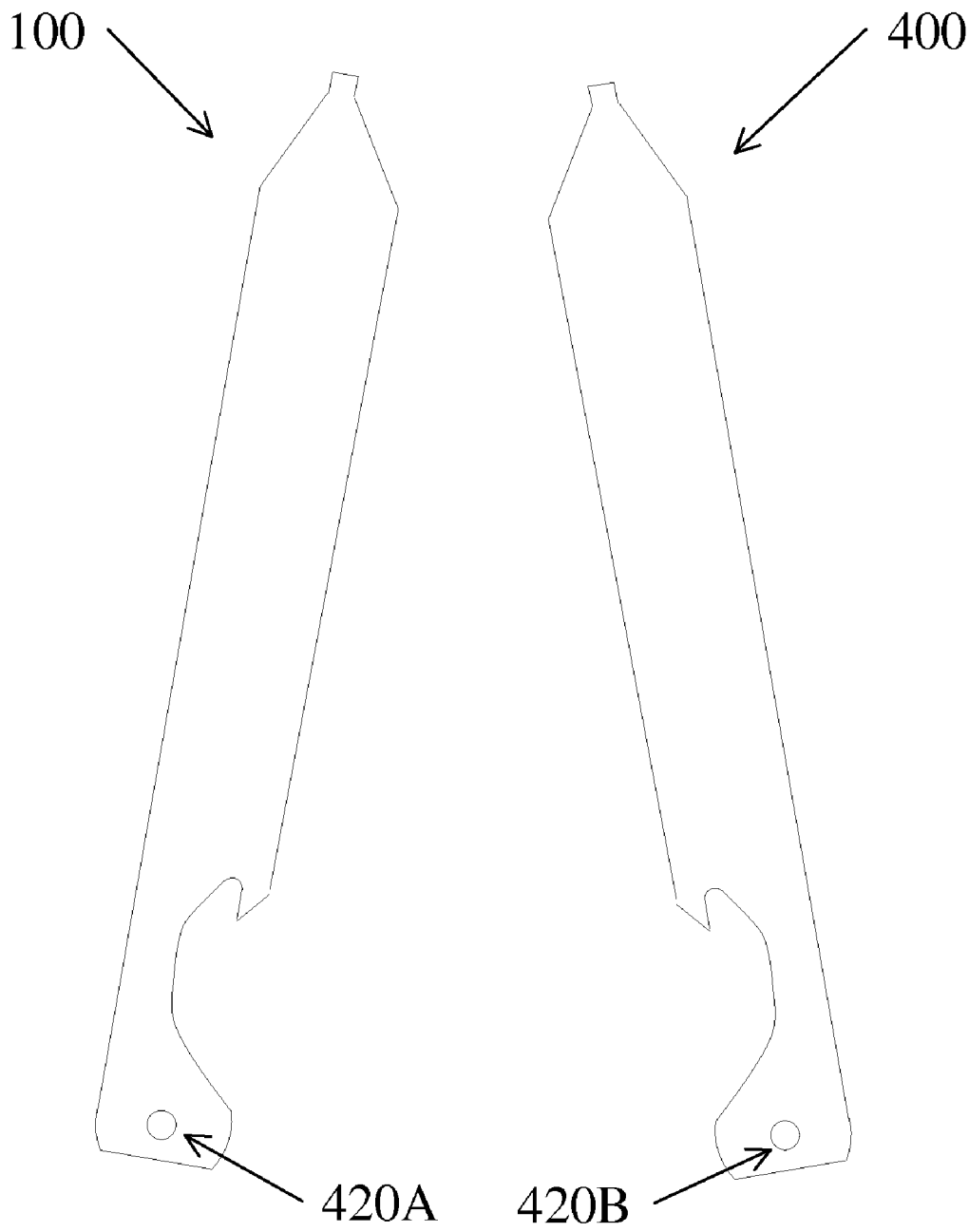
FIG. 4 illustrates an example of two multi-tool collar stays that can be combined to form another tool.

FIG. 4 illustrates another embodiment of the present invention. Collar stay 100 may be inserted into a first collar stay pocket of collar 200, while collar stay 400 may be inserted into a second collar stay pocket of collar 200. In some embodiments, collar stay 100 and collar stay 400 comprise the same tools; examples of these tools for performing or facilitating manual or mechanical work have been described above. However in other embodiments, collar stay 100 and collar stay 400 comprise different tools. According to the present invention, even though collar stay 400 can comprise different tools than those of collar stay 100, these collar stays are essentially the same size. Furthermore, collar stay 100 and collar stay 400 are fabricated so that collar stay 400 can attach to collar stay 100 (or vice versa) to transform into a third tool. Examples of tools that are formed after collar stay 100 and collar stay 400 are put together are scissors, a can opener, and a larger ruler. In accordance with the present invention, collar stay 400 may be attached to collar stay 100 (or vice versa) at any location on either collar stay, such as location 420A and 420B as shown in FIG. 4. In one embodiment, collar stay 400 attaches to collar stay 100 at a pivot point located near second end 106. In another embodiment, collar stay 400 attaches to collar stay 100 at a pivot point located near middle section 104. One exemplary benefit of combining two collar stays is forming a third tool that may provide more leverage and results in a different tool (e.g., scissors, can opener, screwdriver, ruler, etc.) from the individual multi-tool collar stays but adds utility in other manners.

Figure 5:
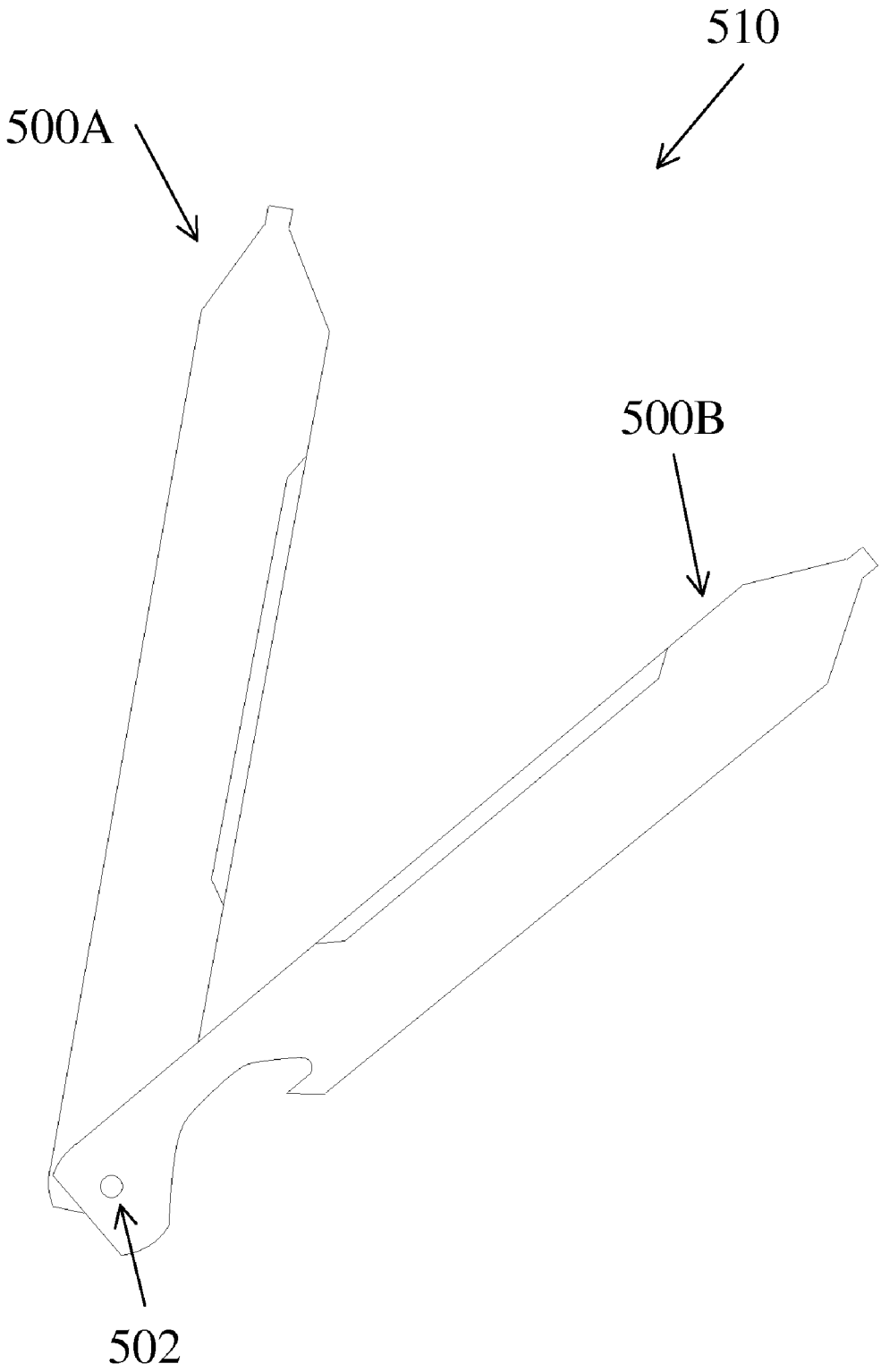
FIG. 5 illustrates an example of a multi-tool collar stay that includes two non-bendable pieces.

FIG. 5 illustrates an embodiment where the collar stay of the present invention includes two non-bendable pieces. In the embodiment shown, collar stay 510 includes first piece 500A and second piece 500B connected via pivot point 502. The edges of 500A and 500B nearest each other may include sharp cutting blades that act as a scissors or cutting blades when 500A and 500B are moved closer together. In accordance with the present invention, when first piece 500A and second piece 500B are placed such that 500A and 500B overlap in order to fit within collar stay pocket 202, the maximum width of collar stay 510 may be in the range of $\frac{1}{8}^{th}$ of an inch to ½ of an inch. In one embodiment of the present invention, the maximum width of collar stay 510 is ¼ of an inch. In order to fit within collar stay pocket 202, the maximum thickness of collar stay 510 is in the range of 1/32 of an inch to 1/4 of an inch.

It should be appreciated that there could be additional tools included within the collar stay of the present invention. For example, the multi-tool collar stay of the present invention could be fitted with a writing instrument such as a pen. The present invention takes particular advantage of its portability and small size. In another example, a key ring hole could be fabricated on the multi-tool collar stay of the present invention as an aesthetic feature to facilitate additional portability. While the present invention is a fashion accessory that has a functional purpose of keeping a collar stiff, the present invention also has additional functions, such as acting as one or more tools.

It will be understood that modifications and variations may be effected without departing from the scope of the present invention. Accordingly, the foregoing description is intended to be illustrative, but not limiting, of the scope of the invention which is set forth in the following claims.

What is claimed is:

1. An apparatus that fits into a collar stay pocket for keeping a shirt collar stiff comprising:

a non-bendable single piece including a first end, a middle section, and a second end, wherein the single piece is shaped to substantially fit within the collar stay pocket, wherein the first end is tapered to be proximate to a collar tip, wherein the middle section includes a ruler having structural markings to measure specific English or Metric Units, wherein the second end is proximate to a collar stay pocket entrance, and at least one of a primary tool is located in the vicinity of the second end.

2. The apparatus of claim 1, wherein the non-bendable single piece comprises at least one of: titanium, brass, stainless steel, sterling silver, reinforced polymer, or a combination thereof.

3. The apparatus of claim 1, wherein the primary tool comprises at least one of: a bottle opener, a cutting blade, a flat head screw driver, a flat Phillips screw driver, a full Phillips screw driver, a nail file, and a ruler having structural markings to measure specific English or Metric units.

4. The apparatus of claim 1, wherein at least one of a supplementary tool is located in the vicinity of the first end, the supplementary tool comprising at least one of: a bottle opener, a cutting blade, a flat head screw driver, a flat Phillips screw driver, a full Phillips screw driver, a nail file, and a ruler having structural markings to measure specific English or Metric units.

5. The apparatus of claim 1, wherein the middle section further comprises at least one of: a bottle opener, a cutting blade, a flat head screw driver, a flat Phillips screw driver, a full Phillips screw driver, and a nail file.

6. The apparatus of claim 1, wherein the middle section and the second end have a maximum width in the range of $1/8^{th}$ of an inch to 1/2 of an inch.

7. The apparatus of claim 1, wherein the maximum thickness of the non-bendable single piece is in the range of 1/32 of an inch to 1/4 of an inch.

8. The apparatus of claim 1, further comprising a non-bendable second piece configured to attach with the first piece to form an additional tool, wherein the second piece is shaped to substantially fit within another collar stay pocket.

9. The apparatus of claim 8, wherein the second piece couples with the first piece at a pivot point located at the second end.

10. The apparatus of claim 8, wherein the additional tool comprises at least one of: scissors, a can opener, and a ruler having structural markings to measure specific English or Metric units.

11. A multi-tool collar stay apparatus comprising:

a non-bendable first piece including a first front section, a first middle section, and a first back section; and a non-bendable second piece coupled with the first piece such that the second piece fits on top of and in-line with the first piece, where a bottom surface of the second piece is in direct contact with a top surface of the first piece, wherein the first piece and second piece are shaped to substantially fit within a collar stay pocket, wherein the first front section is tapered to be proximate to a collar tip, wherein the first middle section includes a ruler having structural markings to measure specific English or Metric Units, wherein the first back section is proximate to a collar stay pocket entrance, wherein the first piece and second piece form at least one of a first tool.

12. The multi-tool collar stay apparatus of claim 11, wherein the first tool comprises: scissors, a ruler having structural markings to measure specific English or Metric units, and a can opener.

13. The multi-tool collar stay apparatus of claim 11, wherein the non-bendable first and second pieces comprise at least one of: titanium, brass, stainless steel, sterling silver, reinforced polymer, or a combination thereof.

14. The multi-tool collar stay apparatus of claim 11, wherein the first piece further includes at least one of a second tool, the second tool comprising at least one of: a bottle opener, a cutting blade, a flat head screw driver, a flat Phillips screw driver, a full Phillips screw driver, a nail file, and a ruler having structural markings to measure specific English or Metric units.

15. The multi-tool collar stay apparatus of claim 11, wherein the second piece further includes at least one of a third tool, the third tool comprising at least one of: a bottle opener, a cutting blade, a flat head screw driver, a flat Phillips screw driver, a full Phillips screw driver, a nail file, and a ruler having structural markings to measure specific English or Metric units.

16. The multi-tool collar stay apparatus of claim 11, further comprising a pivot piece that couples the second piece with the first piece at a pivot point located at the first back section.

17. The multi-tool collar stay apparatus of claim 11, wherein the first middle section further comprises at least one of: a bottle opener, a cutting blade, a flat head screw driver, a flat Phillips screw driver, a full Phillips screw driver, and a nail file.

18. The multi-tool collar stay apparatus of claim 11, wherein the first and second pieces have a maximum width in the range of $1/8^{th}$ of an inch to 1/2 of an inch.

19. The multi-tool collar stay apparatus of claim 11, wherein the maximum thickness of the first and second pieces when the second piece is directly on top of the first piece is in the range of 1/32 of an inch to 1/4 of an inch.

20. The multi-tool collar stay apparatus of claim 11, wherein the second piece includes a second front section, a second middle section, and a second back section, wherein the second front section comprises at least one of: a bottle opener, a cutting blade, a flat head screw driver, a flat Phillips screw driver, a full Phillips screw driver, a nail file, and a ruler having structural markings to measure specific English or Metric units, wherein the second middle section comprises at least one of: a bottle opener, a cutting blade, a flat head screw driver, a flat Phillips screw driver, a full Phillips screw driver, a nail file, and a ruler having structural markings to measure specific English or Metric units, wherein the second back section further comprises at least one of: a bottle opener, a cutting blade, a flat head screw driver, a flat Phillips screw driver, a full Phillips screw driver, a nail file, and a ruler having structural markings to measure specific English or Metric units, wherein the second piece is substantially the same size as the first piece.

* * * * *